US008255208B2

(12) United States Patent
You

(10) Patent No.: US 8,255,208 B2
(45) Date of Patent: Aug. 28, 2012

(54) CODEBOOK SEGMENT MERGING

(75) Inventor: Yuli You, San Diego, CA (US)

(73) Assignee: Digital Rise Technology Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 13/216,111

(22) Filed: Aug. 23, 2011

(65) Prior Publication Data

US 2012/0059659 A1 Mar. 8, 2012

Related U.S. Application Data

(63) Continuation of application No. 12/129,913, filed on May 30, 2008.

(51) Int. Cl.
*G10L 19/00* (2006.01)

(52) U.S. Cl. ..... 704/222; 704/229; 704/230; 704/500

(58) Field of Classification Search ..... 704/222, 704/229, 500–504, 230
See application file for complete search history.

(56) References Cited

U.S. PATENT DOCUMENTS

| | | | | |
|---|---|---|---|---|
| 5,214,742 | A | 5/1993 | Edler | |
| 5,285,498 | A | 2/1994 | Johnston | |
| 5,321,729 | A | 6/1994 | Schroder et al. | |
| 5,394,473 | A | 2/1995 | Davidson | |
| 5,848,391 | A | 12/1998 | Bosi et al. | |
| 6,226,608 | B1 | 5/2001 | Fielder et al. | |
| 6,266,644 | B1 | 7/2001 | Levine | |
| 6,418,412 | B1 * | 7/2002 | Asghar et al. | 704/256.5 |
| 6,487,535 | B1 | 11/2002 | Smyth et al. | |
| 6,952,671 | B1 * | 10/2005 | Kolesnik et al. | 704/222 |
| 7,199,735 | B1 | 4/2007 | Wen et al. | |
| 7,299,190 | B2 | 11/2007 | Thumpudi et al. | |
| 7,328,150 | B2 | 2/2008 | Chen et al. | |
| 7,460,993 | B2 | 12/2008 | Chen et al. | |
| 7,551,785 | B2 * | 6/2009 | Qian et al. | 382/232 |

(Continued)

FOREIGN PATENT DOCUMENTS

WO WO9215153 A2 9/1992

OTHER PUBLICATIONS

Kaukoranta, T. et al. "Iterative split-and-merge algorithm for VQ codebook generation." Optical Engineering, Oct. 1998, pp. 2726-2732.*

"0.8 1.2Vorbis I specification", downloaded from http://xiph.org/vorbis/doc/Vorbis_I_spec.pdf.

Ted Painter and Andreas Spanias, "Perceptual Coding of Digital Audio", Proceedings of the IEEE, vol. 88, No. 4, Apr. 2000, pp. 451-513.

*Primary Examiner* — Talivaldis Ivars Smits
*Assistant Examiner* — Shaun Roberts
(74) *Attorney, Agent, or Firm* — Joseph G. Swan, P.C.

(57) ABSTRACT

Provided are, among other things, systems, methods and techniques for merging entropy codebook application ranges within an audio signal. According to one embodiment, an audio signal is obtained, the audio signal including quantization indexes, identification of segments of said quantization indexes, and indexes of entropy codebooks that have been assigned to such segments, with a single entropy codebook index having been assigned to each said segment; potential merging operations in which specified segments potentially would be merged with each other are identified; bit penalties are estimated for the potential merging operations; then, the potential merging operation having the lowest estimated the penalty is performed.

17 Claims, 8 Drawing Sheets

U.S. PATENT DOCUMENTS

| | | | | |
|---|---|---|---|---|
| 7,599,840 | B2 * | 10/2009 | Mehrotra et al. | 704/501 |
| 7,693,709 | B2 * | 4/2010 | Thumpudi et al. | 704/205 |
| 8,027,380 | B2 * | 9/2011 | Vasilache et al. | 375/240 |
| 2003/0112869 | A1 | 6/2003 | Chen et al. | |
| 2004/0181403 | A1 | 9/2004 | Hsu | |
| 2005/0144017 | A1 | 6/2005 | Kabi et al. | |
| 2005/0192765 | A1 | 9/2005 | Slothers et al. | |
| 2006/0074642 | A1 | 4/2006 | You | |

* cited by examiner

CODEBOOK SEGMENT MERGING

This application is a continuation of U.S. patent application Ser. No. 12/129,913, filed on May 30, 2008, and titled "Audio Signal Transient Detection", which application is incorporated by reference herein as though set forth herein in full. The Background and Summary of the presently claimed invention mainly can be found in the initial paragraphs of the section below titled "Codebook Segment Merging".

FIELD OF THE INVENTION

The present invention pertains to systems, methods and techniques for merging small segments of quantization indexes into larger ones, e.g., to control overhead in processing audio signals.

BACKGROUND

Generally speaking, within the timeframes in which audio signal processing occurs, most of a typical audio signal is quasi-stationary in nature, meaning that its statistics (e.g., in the frequency domain) change relatively slowly. However, it is also fairly common for such quasi-stationary portions to be punctuated and/or separated by transients. A transient can be defined in a variety of different ways, but generally it is a portion of the signal having a very short duration in which the statistics are significantly different than the portion of the signal immediately preceding it and the portion of the signal immediately following it (often, a sudden change in signal energy). It is noted that such preceding and following portions also may differ from each other, depending upon whether the transient occurs during an otherwise quasi-stationary segment or whether it marks a change from one quasi-stationary portion to another.

In order to both efficiently and accurately encode a given audio signal, all or nearly all conventional audio-signal processing techniques encode data in frames (e.g., each consisting of 1,024 new samples together with some overlap of a preceding frame). For the quasi-stationary portions of the signal, a frequency transform typically is provided over the entire frame, thereby providing good frequency resolution.

However, as is well known, the cost of good frequency resolution is poor time resolution. While that result is acceptable for a quasi-stationary portion of the signal, applying a long transform to a portion of an audio signal that includes a transient essentially would spread the transient's energy over the entire transform interval, thereby resulting in significant audible distortion.

Thus, most of the conventional audio-signal-processing techniques attempt to identify where transients occur and then perform different processing within the immediate neighborhood of a transient than is performed for the quasi-stationary portions of the signal. For example, by using a much shorter transform interval, it often is possible to confine the transient's effects approximately to the time interval in which the transient actually occurs. Of course, the cost of such increased time resolution is proportionately poorer frequency resolution. However, good frequency resolution typically is not as important when reproducing a transient, because human audio perception is not as sensitive over such a short period of time.

In order for the foregoing differential processing (between quasi-stationary portions and transient portions) to occur, it is necessary to accurately identify where transients occur in the first instance. Several different conventional approaches have been employed for detecting transients within an audio signal. Examples include simply defining a transient whenever an amplitude change of sufficient magnitude occurs or transforming the audio signal into the frequency domain and then defining a transient whenever a frequency change of sufficient magnitude occurs. However, each of such approaches has its own limitations.

SUMMARY OF THE INVENTION

The present invention addresses this problem, e.g., by comparing a maximum block norm value to a different second maximum block norm value within a desired segment, by using a multi-stage technique, and/or by using multiple different criteria based on norm values of signal blocks.

Thus, for example, one embodiment of the invention is directed to detecting whether a transient exists within an audio signal, in which a segment of a digital audio signal is divided into blocks, and a norm value is calculated for each of a number of the blocks, resulting in a set of norm values for such blocks, each such norm value representing a measure of signal strength within a corresponding block. A maximum norm value is then identified across such blocks, and a test criterion is applied to the norm values. If the test criterion is not satisfied, a first signal indicating that the segment does not include any transient is output, and if the test criterion is satisfied, a second signal indicating that the segment includes a transient is output. According to this embodiment, the test criterion involves a comparison of the maximum norm value to a different second maximum norm value, subject to a specified constraint, within the segment.

Another embodiment is directed to detecting whether a transient exists within an audio signal, in which a segment of a digital audio signal is divided into blocks. A norm value is calculated for each of a number of the blocks, resulting in a set of norm values for such blocks, each such norm value representing a measure of signal strength within a corresponding block. A maximum norm value is identified across such blocks, and a preliminary criterion is applied to the norm values. If the preliminary criterion is not satisfied, a signal indicating that the segment does not include any transient is output, and if the preliminary criterion is satisfied, a test criterion is applied to the norm values. If the test criterion is applied but not satisfied, a first signal indicating that the segment does not include any transient is output, and if the test criterion is applied and satisfied, a second signal indicating that the segment includes a transient is output. According to this embodiment, at least one of the preliminary criterion and the test criterion is based on the maximum norm value.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

DESCRIPTION OF THE PREFERRED EMBODIMENT(S)

The present disclosure is divided into sections. The first section describes audio signal transient detection. The second section describes codebook merging. The third section describes joint channel coding.

Audio Signal Transient Detection

Figure 1:
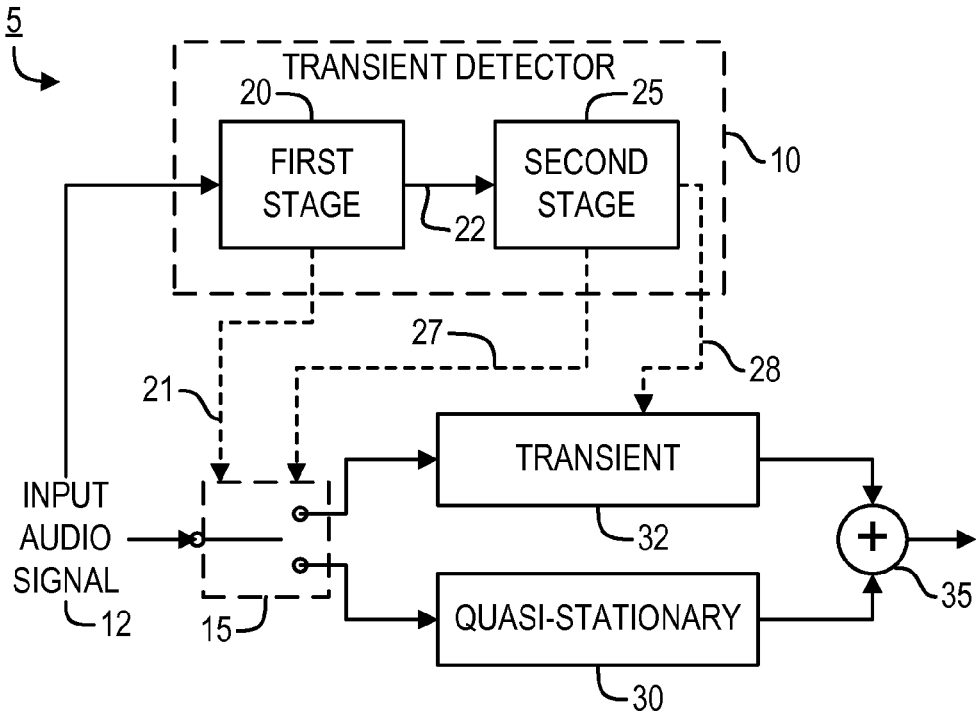
FIG. 1 is a block diagram of an exemplary system within which a transient-detection system or a technique according to the present invention might operate.

FIG. 1 illustrates an exemplary system 5 within which might operate a transient-detection system or technique 10 (referred to herein as transient detector 10) according to a representative embodiment of the present invention. As shown in FIG. 1, an input audio signal 12 preferably is provided to two components of system 5: the transient detector 10 and processing switch 15. In the preferred embodiments of the invention transient detector 10 includes a first processing stage 20 and a second processing stage 25, and the input audio signal 12 initially is provided to the first stage 20. However, it should be noted that transient detector 10 instead might include a single processing stage that includes any or all of the processing discussed below in connection with stages 20 and 25, e.g., with just a single final decision regarding the existence of a transient after all evaluation processing has been performed.

Preferably, input audio signal 12 is a digital audio signal that already has been segmented into frames (or other kinds of segments), and transient detector 10 makes decisions regarding the existence of a transient on a frame-by-frame (or, more generally, segment-by-segment) basis. In this regard, although the following discussion sometimes refers to processing in frames, such references are for ease of discussion only and, unless expressly and specifically noted to the contrary, each such reference can be replaced by a more generic reference to any other kind of segment.

The first stage 20 of transient detector 10 preferably makes a preliminary decision regarding the existence of a transient within the current frame, either: (1) ruling out the possibility of a transient, in which case a signal 21 is provided to processing switch 15 instructing it to process the current frame using a technique 30 for processing quasi-stationary frames; or (2) determining that the current frame possibly contains a transient, in which case a signal 22 (e.g., either the original signal 12 or a modified version of it, preferably together with any additional information determined in the first stage 20) is provided to the second processing stage 25.

Within the second stage 25, a final determination is made as to whether a transient exists within the current frame. If a transient is detected in stage 25, then the output control signal 27 instructs processing switch 15 to process the current frame using a technique 32 for processing transient frames, and an output signal 28 preferably indicates the location within the frame where the transient occurs (although in alternate embodiments, e.g., where a transient frame is processed uniformly without regard to precisely where the transient occurs within the frame, output signal 28 is omitted). Otherwise (i.e., if the second stage 25 determines that no transient exists within the current frame), the output control signal 27 instructs processing switch 15 to process the current frame using the technique 30 for processing quasi-stationary frames. The individual frames processed by modules 30 and 32 are then combined in module 35 and transmitted, stored or output to the next processing unit.

Preferably, both the technique 30 for processing quasi-stationary frames and the technique 32 for processing transient frames are part of an overall signal encoding process, e.g., using the variable-block-size MDCT (Modified Discrete Cosine Transform). More preferably, such techniques employ some or all of the processes described in any or all of the following commonly assigned U.S. patent applications: Ser. No. 11/029,722 filed Jan. 4, 2005 (now U.S. Pat. No. 7,630,902), Ser. No. 11/558,917 filed Nov. 12, 2006, Ser. No. 11/669,346 filed Jan. 31, 2007 (now U.S. Pat. No. 7,895,034), and Ser. No. 11/689,371 filed Mar. 21, 2007 (now U.S. Pat. No. 7,937,271), each of which being incorporated by reference herein as though set forth herein in full.

As discussed in those applications, one significant distinction between processing quasi-stationary frames and processing transient frames typically is the transform block size that is used for the frame. Preferably, when processing each frame, a uniform transform block size is used across the entire frame. More preferably, a long transform block (e.g., the length of the entire frame, covering 2,048 samples, which include 1,024 new samples) is used for a quasi-stationary frame and multiple short transform blocks (e.g., eight short transform blocks, each covering 256 samples, which include 128 new samples) are used for a frame containing a transient.

In addition, in the embodiments discussed in the above-referenced commonly assigned patent applications, the specific location of the transient within the frame is used to control the window functions that are applied to each block within the transient frame. As a result, accurate detection of the location of a transient has important implications with respect to the processing of the audio signal in the preferred embodiments of the invention.

Figure 2:
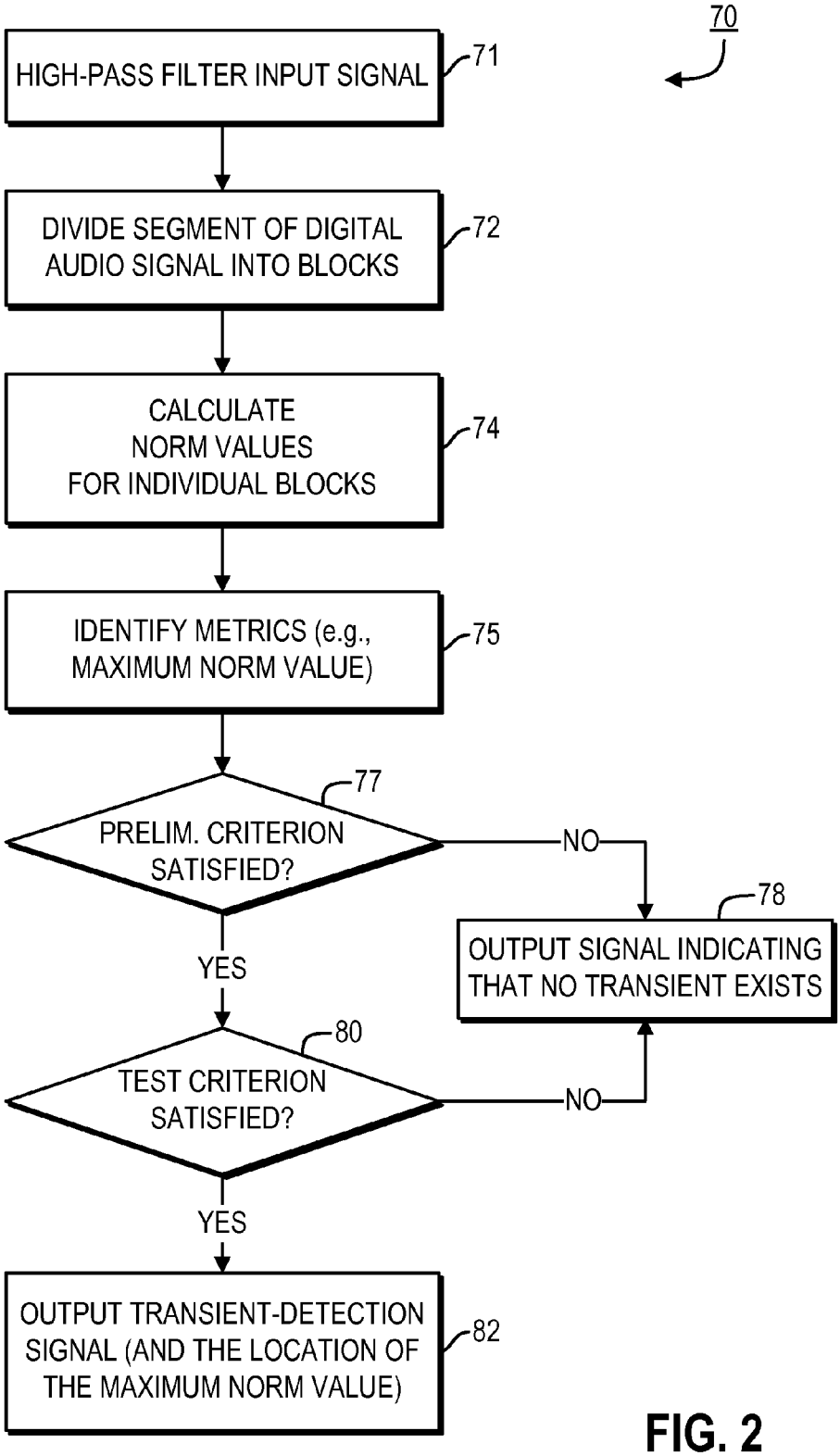
FIG. 2 illustrates a flow diagram of a process for determining whether a transient exists within a segment (e.g., a frame) of an input audio signal, according to the preferred embodiments of the present invention.

FIG. 2 illustrates a flow diagram of an exemplary process 70 for determining whether a transient exists within a single frame (or other segment) of an input audio signal and, if so, where. Process 70 may be implemented, e.g., by transient detector 10 (shown in FIG. 1). In the preferred embodiments, the steps of process 70 are fully automated so that they may be implemented by a processor reading and executing computer-executable process steps from a computer-readable medium, or in any of the other ways discussed herein.

Initially, in step 71 the input digital audio signal (e.g., signal 12 shown in FIG. 1) is high-pass filtered. At this point, the input signal preferably is in the time-sampled domain, so the general form of the filtering operation preferably is:

$$y(n) = \sum_k x(n-k)h(k),$$

where x(n) is the $n^{th}$ sample value of the input signal and h(k) is the impulse response of the high-pass filter. One such filter is a Laplacian, whose impulse response function may be given by h(n)=[1,−2,1].

Figure 3:
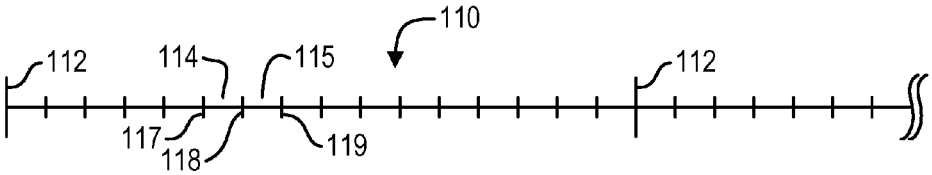
FIG. 3 illustrates the division of an audio frame into blocks.

Next, in step 72 the segment of the digital audio signal that is being evaluated (e.g., a single audio frame) is divided into blocks. In the preferred embodiments, the block size is uniform, and an integer multiple of the block size is equal to the short transform block size. In embodiments where the long transform block consists of 2,048 samples (1,024 new samples) and each of the eight short transform blocks in a frame consists of 256 samples (128 new samples), the block size preferably consists of 64 samples. The blocks resulting from this step 72 preferably are non-overlapping, contiguous and together cover all of the new samples in the entire frame (i.e., in the current example, 16 blocks, each having 64 samples so as to cover all 1,024 new samples). Thus, referring to FIG. 3, a single frame 110, defined by frame boundaries 112, is divided into 16 contiguous non-overlapping blocks (e.g., blocks 114 and 115, defined by block boundaries 117-118 and 118-119, respectively).

In step 74, norm values are calculated for the individual blocks. Preferably, a norm value is separately calculated for each of the blocks identified in step 72. More preferably, each such norm value is a measure of the signal strength (e.g., energy) of the block to which it corresponds and is calculated as a functional combination of all sample values within the block. The most straightforward norm to calculate is the L2 norm, which essentially is the total block energy, preferably defined as follows:

$$E(k) = \sum_{i=0}^{L-1} y(kL+i)y(kL+i),$$

$$k = 0, 1, \ldots, K-1,$$

where k is the block number, K is the total number of blocks in the frame, and L is the number of samples in each block. Of course, total block energy also could be expressed as an average by simply applying a factor of 1/L to the summation above.

In order to reduce computional load, one alternate embodiment uses the following L1 norm, which essentially is a measure of combined absolute signal values within the block:

$$E(k) = \sum_{i=0}^{L-1} |y(kL+i)|,$$

$$k = 0, 1, \ldots, K-1.$$

Once again, the total or combined value could be expressed as an average by simply applying a factor of 1/L to the summation above. Still further, in alternate embodiments other, e.g., more sophisticated norms, such as perceptual entropy, can also (or instead) be calculated in this step 74 and then used throughout the rest of the process 70.

In step 75, one or more metrics are identified based on the norm values calculated in step 74. In the preferred embodiments, such metrics include the maximum norm value, which (as indicated above) preferably is equivalent to identifying the greatest signal strength (however defined) across all of the blocks, together with the identity of the block in which such maximum value occurs. The maximum norm value preferably is simply defined as:

$$E_{max} = \max_{k=0,1,\ldots,K-1} E(k).$$

Such metrics preferably also include the minimum norm value and the identity of the block in which such minimum value occurs. The minimum norm value preferably is simply defined as:

$$E_{min} = \min_{k=0,1,\ldots,K-1} E(k).$$

The identified metrics preferably further include the maximum of absolute difference between adjacent norm values, i.e.:

$$D_{max} = \max_{k=0,1,\ldots,K-1} |E(k) - E(k-1)|.$$

However, the actual metrics identified in this step 75 preferably depend upon the criteria to be applied in steps 77 and 80 (discussed below) of the process 70. Accordingly, some subset of the foregoing metrics and/or any additional or replacement metrics instead (or in addition) may be identified in this step 75.

In step 77, a determination is made as to whether a specified preliminary criterion pertaining to the potential existence of a transient is satisfied. In the preferred embodiment, this preliminary criterion is not satisfied if any of the following conditions is found to be true:

$E_{max} < k_1 E_{min}$, where $k_1$ is a tunable parameter $k_2 D_{max} < E_{max} - E_{min}$, where $k_2$ is a tunable parameter $E_{max} < T_1$, where $T_1$ is a tunable threshold $E_{min} > T_2$, where $T_2$ is a tunable threshold If the audio signal is represented by 24 bits per sample, i.e., providing for a range of integer values of $[-2^{23}, 2^{23}]$, and the L1 norm is used, it is preferred that $k_1=4$, $k_2=3$, $T_1=600{,}000$, and $T_2=3{,}000{,}000$, or other values that are approximately equal to the foregoing.

Stated differently, the preliminary criterion preferably is satisfied only if all of the following conditions are satisfied:

$E_{max} \geqq k_1 E_{min}$ $k_2 D_{max} \geqq E_{max} - E_{min}$ $E_{max} \geqq T_1$ $E_{min} \leqq T_2$ Generally speaking, the first condition is an example of a requirement that the maximum norm value is at least a specified degree larger than the minimum norm value. In the particular embodiment specified above, the maximum norm value is at least a factor $k_1$ larger than the minimum norm value (because $k_1$ preferably is larger than one). However, in alternate embodiments, any other requirement regarding how much larger the maximum norm value must be than the minimum norm value instead may be specified.

The second condition set out above is an example of a requirement that the maximum absolute difference is at least a specified fraction of the difference between the maximum norm value and the minimum norm value (because $k_2$ preferably is larger than one). However, once again, any other requirement in this regard instead may be specified.

As indicated above, the preliminary criterion can have multiple conditions and/or tests that need to be satisfied in any combination (e.g., disjunctive, conjunctive and/or score-based where a cumulative score from multiple different tests must satisfy a specified threshold for a particular condition to be satisfied) in order for the entire preliminary criterion to be satisfied. While the foregoing conditions are preferred, any subcombination of such conditions and/or any additional or replacement conditions may be used. Certain conditions might be desirable for processing efficiency, e.g., in order to eliminate cases where it is highly unlikely that the test criterion (discussed below) will be satisfied, while the omission of such a condition will not significantly affect the ultimate decision. On the other hand, other conditions might evaluate substantively different characteristics pertaining to the potential existence of a transient.

In any event, if the preliminary criterion is not satisfied, then processing proceeds to step 78 in which a final conclusion is made that the current segment does not include a transient. Preferably, a result of this conclusion is the provision (by step 78) of control signal 21 (shown in FIG. 1) instructing the processing of the current segment (e.g., audio frame) as a quasi-stationary segment (or frame). On the other hand, if the preliminary condition is satisfied, then processing proceeds to step 80.

It is noted that step 77 can be performed in the first stage 20 of transient detector 10 (both shown in FIG. 1). Preliminary steps 71, 72 and 74 similarly can be performed by first stage 20, or any or all of such preliminary steps can be performed in a separate pre-processing module (not shown) of transient detector 10. Step 80 can be performed in the second stage 25 of transient detector 10 (both shown in FIG. 1), and the signal 22 provided from the first stage 20 to the second stage 25 can include any of the metrics calculated in the first stage 20 and/or in any pre-processing module.

In step 80, a determination is made as to whether a specified test criterion has been satisfied. Preferably, the test criterion involves a comparison of the maximum norm value to one or more different other maximum norm values within the segment. More preferably, each such other maximum norm value is a maximum value within the segment subject to a specified constraint. In the preferred embodiment, the test criterion requires that the maximum norm value is at least a specified degree larger than both (1) the largest norm value prior to a spike that includes the maximum norm value and (2) the largest norm value within a specified sub-segment following the maximum norm value. More specifically, the preferred embodiment of this step 80 is performed by the following sequence.

Initially, a search is conducted across the blocks prior to the block $k_{max}$ in which the maximum norm value occurs, in order to locate where the norm values begin to increase (i.e., the location of the beginning of the "attack"), as follows:

```
for (k=k_max −1; k>0; k−−) {
        if ( E[k−1] > E[k] ) {
                break;
        }
}
PreK = k−1
```

Next, a "pre-attack peak" preferably is identified as follows:

$$PreE_{max} = \max_{k=0,1,\ldots,PreK} E(k).$$

Generally speaking, in this embodiment $PreE_{max}$ is the largest norm value prior to the spike that includes $E_{max}$.

Figure 4:
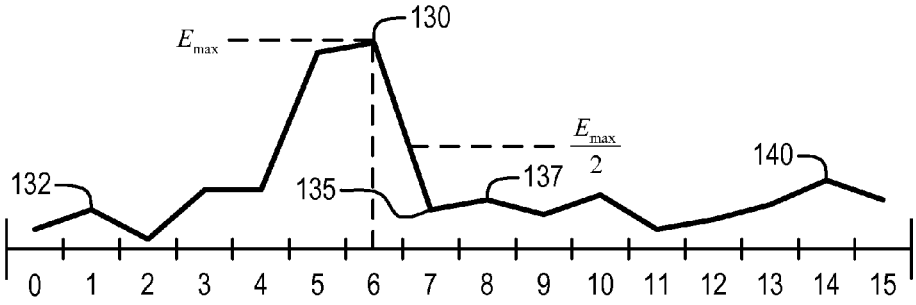
FIG. 4 illustrates norm values for individual blocks within a single frame, as well as certain information that is relevant to determining whether a transient exists within the frame, according to a representative method of the present invention.

In the example shown in FIG. 4, each norm value is depicted at the center of the block to which it pertains. Moving backward from the maximum norm value 130 ($E_{max}$, which occurs at $k_{max}$=6), it is determined that PreK=1. Searching backward from and including this position 132, it is determined that the same position 132 (k=1) also corresponds to $PreE_{max}$ in this example.

In the preferred embodiment, a search also is conducted across all blocks subsequent to the block $k_{max}$ in which the maximum norm value occurs, in order to find the location where the norm values begin to increase (i.e., the location of the end of the "fall"), but which is also larger than half of $E_{max}$, as follows:

```
k = k_max;
do {
        k++;
        for (; k<K−1; k++) {
                if ( E[k+1] > E[k] )
                        break;
        }
        if ( k+1>=K )
                break;
} while ( 2*E[k] > E_max );
PostK = k+1;
```

Next, a "post-attack" peak preferably is identified as follows:

$$PostE_{max} = \max_{k=PostK,\ldots,K-1} E(k)$$

Generally speaking, in this embodiment $PostE_{max}$ is the largest norm value in the segment starting with the first uptick (as indicated by an increase in the norm value from the preceding block) at which the norm value is less than $$\frac{E_{max}}{2}$$

that occurs after $E_{max}$.

In the example shown in FIG. 4, moving forward from the maximum norm value 130, the point 135 at which the norm value has fallen to less than $$\frac{E_{max}}{2}$$

occurs at the same position as the first uptick after $k_{max}$. Accordingly, the search forward for $PostE_{max}$ begins at position 137, i.e., PostK=8 in this example, and $PostE_{max}$ is found at position 140 (or k=14).

Finally, a determination is made as to whether the test criterion is satisfied in the current segment (e.g., audio frame). In the preferred embodiment, the test criterion is satisfied if:

$$E_{max} > k_3 \max(PreE_{max}, PostE_{max}),$$

where $k_3$ is a tunable parameter. If the audio signal is represented by 24 bits per sample and the L1 norm is used, it is preferred that $k_3$=2.

It is noted that variations on the foregoing test criterion are possible. For example, the specification of one half $E_{max}$ as the potential point (PostK) at which the search forward for $PostE_{max}$ begins can be modified to any other desired fraction of $E_{max}$. Similarly, such a condition can be eliminated entirely, with PostK being solely determined by the point (if any) at which norm values begin to rise following $E_{max}$ (in a similar manner to the way that PreK is determined).

As with the preliminary criterion discussed above, the test criterion can have multiple conditions and/or tests that need to be satisfied in any combination in order for the entire test criterion to be satisfied. Also, as indicated above, in alternate embodiments all of the required tests and conditions are incorporated into the test criterion (omitting the preliminary criterion altogether), so that a single decision output is provided after evaluation of the test criterion.

In any event, if the test criterion is satisfied, then processing proceeds to step 82. Otherwise, processing proceeds to step 78 (discussed above).

In step 82, a final conclusion is made that the current segment includes a transient. Preferably, a result of this conclusion is the provision of control signal 27 (shown in FIG. 1) instructing the processing of the current segment (e.g., audio frame) as a transient segment (or frame). Also, in the preferred embodiments the location of the transient is provided in a signal 28 to transient-frame-processing module 32, e.g., so that window functions can be specified based on the location of the transient with the frame. Preferably, the location of the transient is based on the location $k_{max}$ where the maximum norm value occurs. For example, the transient location may be specified by $k_{max}$ alone. Alternatively, e.g., signal 28 may include PreK and/or PostK, in addition to $k_{max}$.

Codebook Segment Merging.

Statistical approaches to entropy codebook assignment are presented in U.S. patent application Ser. No. 11/029,722. One of such approaches segments quantization indexes into statistically coherent segments such that within each segment, quantization indexes share similar statistics. The segments are then assigned entropy codebooks with matching statistical properties, so as to achieve a better match between the statistical properties of the entropy codebook and the statistics of the quantization indexes to which it is applied.

This method, however, typically needs to convey the width information of such segments to the decoder as side information, in addition to the usual codebook indexes. As a result, the greater the number of such segments, the more bits typically are needed to convey this additional side information to the decoder. In some cases, the number of segments could be so large that the additional overhead might more than offset the saving of bits due to the better matching of statistics between the codebook and the quantization indexes. Therefore, segmentation of quantization indexes into larger segments or the merging of small segments into larger ones (in either case, resulting in a smaller total number of segments) is desirable for the successful control of this overhead.

A segment merging method that was presented in U.S. patent application Ser. No. 11/029,722 merges an isolated, narrow segment whose codebook index is smaller than its immediate neighbors to one of its neighbors by raising the codebook index to the smallest codebook index of its immediate neighbors. Because an increased codebook index preferably corresponds to an enlarged codebook, typically requiring more bits to encode the quantization indexes in the segment, there is a penalty in terms of increased number of bits associated with increasing the codebook index for a given segment.

The referenced segment-merging method in U.S. patent application Ser. No. 11/029,722 tries to minimize this bit penalty by merging only the isolated, narrow segments because they contain a smaller number of quantization indexes. However, this approach does not always lead to minimum penalty because a large increase in the codebook index for a narrow segment might still cause an increase in the total number of bits. The present approach addresses that problem, e.g., by iteratively merging the segment that currently results in the smallest bit penalty.

Figure 5:
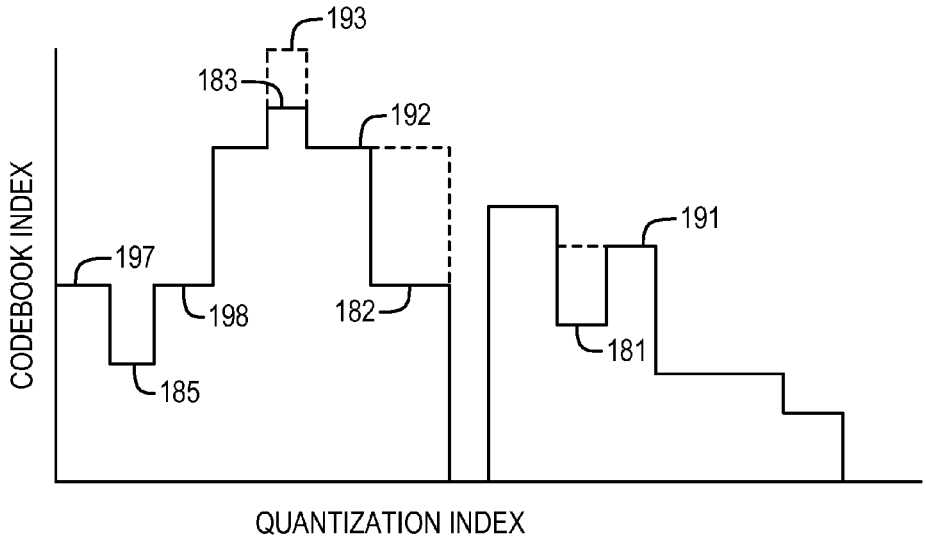
FIG. 5 illustrates quantization index segments and corresponding indexes.

Let us assume that the application of a codebook segmentation procedure (e.g., the procedure described in U.S. patent application Ser. No. 11/029,722, excluding any segment merging) results in N codebook segments. One example is shown in FIG. 5. Each of such segments may be described by the pair (I[n], W[n]) where I[n] is the codebook index and W[n] is the number of quantization indexes (i.e., the segment width). A codebook segment n, $0 \leqq n < N$, potentially could be eliminated by merging it either with its immediate left neighbor (resulting in the use of codebook I[n−1] for the segment n) or its immediate right neighbor (resulting in the use of codebook I[n+1] for the segment n), e.g., as long as the codebook for the merged segment is larger so that it can accommodate all quantization indexes in segment n.

Because a codebook library can always be arranged in such a way that a larger codebook index corresponds to a larger codebook, this entails setting I[n] to the codebook index of one of its immediate neighbors that is larger than I[n]. For this, there exist three cases, outlined as follows:

1. If I[n] is smaller than the codebook indexes of both its neighbors, such as the codebook for segment 181 in FIG. 5, the smaller codebook of its neighbors (e.g., the codebook for segment 191 in FIG. 5) preferably is used because a larger codebook usually results in more bits for coding the same set of quantization indexes.
2. If I[n] lies between the codebook indexes of its neighbors, such as the codebook for segment 182 in FIG. 5, I[n] preferably is set to the larger codebook of the two neighbors, i.e., the index that is larger than I[n] (e.g., the codebook for segment 192 in FIG. 5).
3. In the extreme case where I[n] is larger than both its neighbors, such as the codebook for segment 183 in FIG. 5, the segment preferably is not merged with either its left or right neighbor, but instead is excluded from the segment-merging operation. This can be achieved by using Imax (e.g., codebook 193 in FIG. 5), the maximum codebook index in the codebook library, as discussed below.

Based on the above considerations, we can assign to each segment a target codebook index, e.g., as follows:

$$T[n] = \begin{cases} I_{max}, & \text{if } I[n] > I[n-1] \text{ and } I[n] > I[n+1]; \\ \min\{I[n-1], I[n+1]\}, & \text{if } I[n] < I[n-1] \text{ and } I[n] < I[n+1]; \\ \max\{I[n-1], I[n+1]\}, & \text{otherwise.} \end{cases}$$

The neighbor with which each segment potentially would be merged is called its target neighbor, e.g.:

$$G[n] = \begin{cases} n-1, & \text{if } T[n] = H[n-1]; \\ n+1, & \text{if } T[n] = H[n+1]. \end{cases}$$

If we actually set I[n]=T[n] for a given segment n, then segment n can be considered to be effectively merged into its corresponding neighbor G[n]. There is, however, a penalty, in terms of increased bits, associated with such a merger because a larger codebook would then be used for all quantization indexes in segment n. This bit penalty of merging may be estimated as simply as $$C[n]=W[n](H[T[n]]-H[I[n]]),$$

where H[x] is the entropy associated with codebook x. Other measures of bit penalty for each potential merging operation also (or instead) can be used here, such as the difference between the actual numbers of bits for encoding all quantization indexes in this segment using codebooks T[n] and I[n], respectively. Note that, by setting $T[n]=I_{max}$, we essentially assign the maximum bit penalty to merging segment n.

Figure 6:
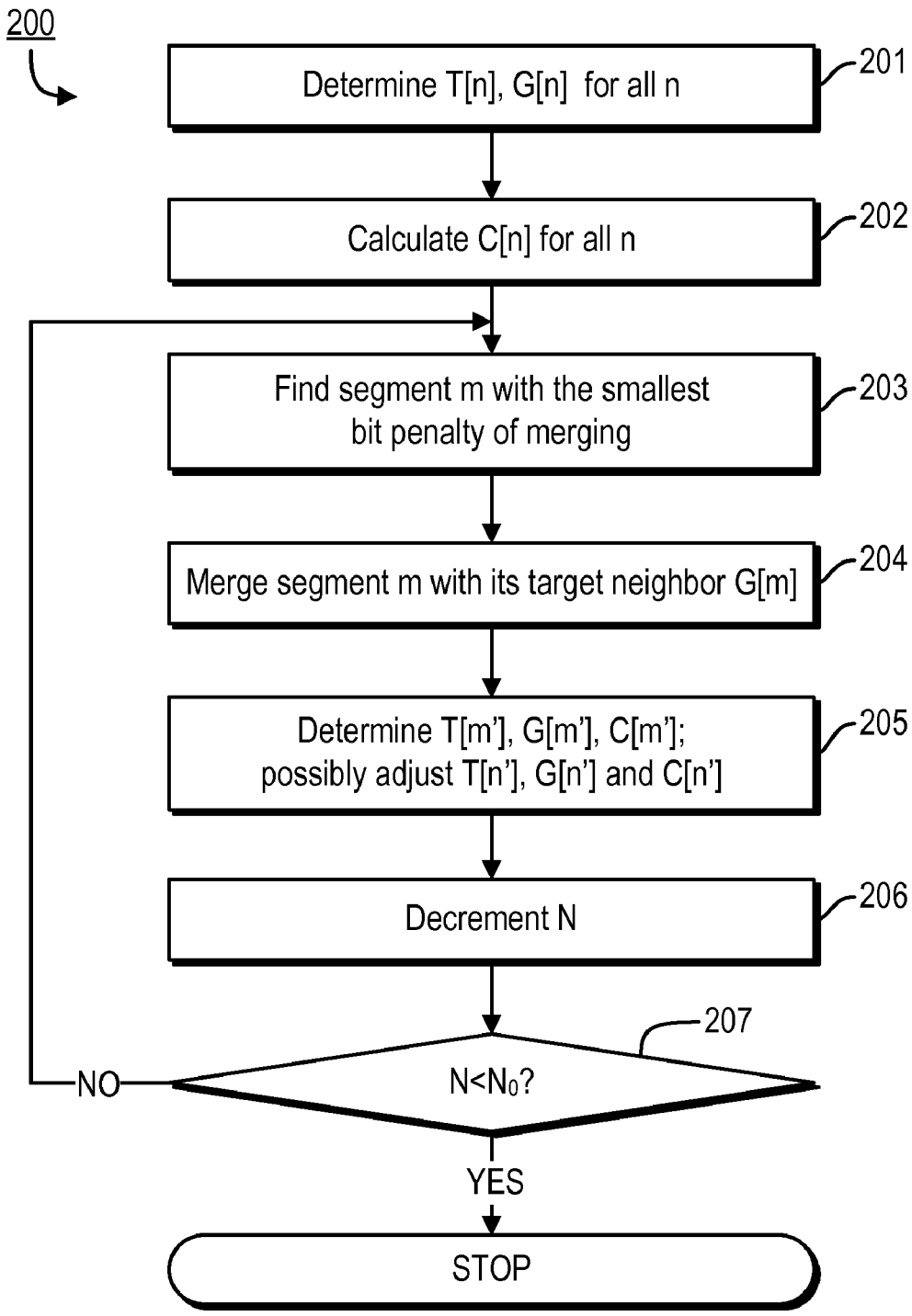
FIG. 6 is a flow diagram illustrating a process for merging codebook segments.

Due to this bit penalty, one approach to segment merging is to find the segment with the smallest bit penalty of merging and merge it with its identified neighbor G[n]. One example of such a process 200 is now described with reference to FIG. 6. In the preferred embodiments, process 200 is fully automated so that it can be executed by a computer processor reading and executing computer-executable process steps, or in any of the other ways described herein.

Initially, in step 201 a target codebook index T[n] and corresponding target neighbor G[n] are determined for each segment n, $0 \leqq n < N$, e.g., as discussed above.

In step 202, the bit penalty C[n] of merging segment n into target neighbor G[n] is calculated for each segment n, $0 \leqq n < N$, e.g., using any of the penalty functions discussed above.

In step 203, the segment m with the smallest bit penalty of merging is identified, e.g.:

$$C[m] = \underset{0<n<N-1}{\mathrm{MIN}} C[n]$$

In step 204, segment m is merged with its target neighbor G[m].

In step 205, T[m'], G[m'] and C[m'] are determined, where m' is the newly merged segment (i.e., the segment resulting from the merger of m and G[m]), and any appropriate adjustments are made to T[n'], G[n'] and C[n'], where n' is the other segment neighboring m. This latter adjustment may be necessary, e.g., if the increase in the codebook index for segment m results in a change in the optimal potential merging operation for n'.

In step 206, the number of segments is decremented, e.g.: N=N−1.

In step 207, a determination is made as to whether $N<N_0$, where $N_0$ denotes the maximum number of segments that is allowed. If so, processing is complete because the target number $N_0$ of segments has been achieved. If not, processing returns to step 203 in order to identify the next segment to be merged.

In one representative embodiment, the value of $N_0$ is fixed in advance and the foregoing process 200 is performed just one time. In an alternate embodiment, the foregoing process 200 is repeated for multiple different values of $N_0$, and the value resulting in the greatest bit efficiency (actual or estimated) is selected for encoding the current data.

It is noted that the foregoing process 200 essentially values each merge operation equally. However, a single merge operation sometimes can decrease the number of segments by two. For example, referring back to FIG. 5, the two neighbors of segment 185 (i.e., segments 197 and 198) use the same codebook, so changing the codebook for segment 185 to match theirs effectively would combine all three segments into one. Accordingly, in certain embodiments an adjustment is made to account for such an elimination of an additional segment. For example, the penalty C[n] for such a "double-merge" segment may simply be halved from what it otherwise would be. Alternatively, the process could tentatively select the merging operation having the lowest penalty in the current and the next iterations, combine the penalties associated with eliminating two segments in that manner, and then back up and instead merge the single "double-merge" segment if such combined penalties exceed the penalty associated with merging the single "double-merge" segment.

Similar considerations can also apply even in situations where the two neighboring segments do not use exactly the same codebook. In this regard, it is noted that the foregoing process 200 evaluates just a single potential merging operation at a time. However, evaluating each merging operation in isolation from the ones that precede or follow it might not always result in an optimal solution. Accordingly, alternate embodiments use a technique (e.g., a comprehensive search or a linear programming technique) that evaluates sequences of merging operations before deciding on which ones to merge.

Also, the foregoing process 200 repeats until a specified number $N_0$ of segments remains. In alternate embodiments, the process repeats (or continues, e.g., in the case of evaluating sequences of merging operations) based on a bit-saving criterion, e.g., for as long as the actual or estimated net bit savings from eliminating segments remains positive.

Joint Channel Coding.

The pulse-coded modulation (PCM) samples of an audio signal having C channels may be represented by x[c][n], where c=0, 1, . . . , C−1 is the channel index and n is an integer representing the sampling instance. When a multichannel audio signal is coded, the PCM samples of each channel usually are first transformed into frequency coefficients or subband samples using any of a variety of transforms or subband filter banks, such as discrete cosine transform (DCT), modified discrete cosine transform (MDCT) or cosine modulated filter banks Because frequency coefficients can be considered as special subband samples, the following discussion refers to them as subband samples. Typically, the transform or filter bank is applied to the PCM samples in a block-sliding and overlapping fashion such that each application generates a "transform block" of M subband samples. The resulting signal can be represented as: X[c][b][m], where b is an integer representing the block index and m=0, 1, . . . , M−1 is the index for the subband samples.

A single transform block of subband samples can be coded independently or, alternatively, multiple transform blocks can be grouped into a "macro block" and coded together. In this latter case, the subband samples from the different transform blocks are usually reordered so that subband samples corresponding to the same frequency are placed next to each other. This macro block can still be represented by the nomenclature X[b][c][m], except that the number of samples is now a multiple of the number of samples in each individual transform block. Therefore, the following discussion will not distinguish between a transform block and a macro block (instead referring generically to a "block" that includes M subband samples), except where relevant.

Since subband samples in each block are coded independently from those of other blocks, for simplicity the block index b typically is dropped in the following discussion, so that the subband samples in block b are represented as X[c][m]. It is noted that one or more transform blocks or macro blocks can be assembled into a frame, but doing so generally does not affect the nature of the present coding techniques.

Typically, the subband samples in a block are segmented into quantization units based on critical bands of a human perceptual model, and then all subband samples in each quantization unit are quantized using a single quantization step size. Preferably, the boundaries of the quantization units at least loosely correspond in frequency to the boundaries of the critical bands.

One approach to defining quantization units is to use an array, such as $\{q_0, q_1, \ldots, q_{Q-1}\}$, where $q_i$ is the i-th quantization unit and Q is the total number of quantization units. For a given arrangement of critical bands, this array is usually determined by the block size M and the sampling frequency. For M=128 and a sample rate of 48 kHz, for example, the following is a valid quantization array:

{4,4,4,4,4,4,5,6,7,9,14,27,36}, where each number represents the number of subband samples in a quantization unit.

Let Δ[c][q] denote the quantization step size for quantization unit q of channel c. Then, the subband sample X[c][m] typically is quantized so as to generate a quantization index I[c][m] according to the following formula:

$$I[c][m]=f(X[c][m],\Delta[c][q]),m\epsilon q$$

where function f(.) represents the quantization scheme used. The subband samples may then be reconstructed from the quantization index via $$\hat{X}[c][m]=f^{-1}(I[c][m],\Delta[c][q]),m\epsilon q$$

where the inverse function $f^{1}(.)$ represents the dequantization scheme corresponding to the quantization scheme f(.). In this case, the mean square quantization error (or power of quantization noise) can be calculated as follows:

$$\sigma^2[c][q] = \sum_{m\in q} \left(X[c][m] - \hat{X}[c][m]\right)^2.$$

Given a quantization scheme f(.), the power of quantization noise $\sigma^2$[c][q] is largely proportional to the quantization step size Δ[c][q]. Therefore, a small step size is desirable in terms of less quantization noise. However, a small step size leads to more bits for encoding the quantization indexes. This could quickly exhaust the bit resource available to encode the subband samples in the whole frame. There is, therefore, a need to optimally allocate the available bit resource to the various quantization units so that the overall quantization noise is inaudible or, at least, minimally audible.

The measure of audibility can be based on the masking threshold calculated in accordance with a perceptual model. According to the teachings of psychoacoustic theory, there is a masking threshold for each critical band, below which noise or other signals are not audible. Let $\sigma^2_m$[c][q] denote the power of the masking threshold for quantization unit q of channel c. Then, the noise-to-mask ratio (NMR), defined as $$NMR[c][q] = \frac{\sigma^2[c][q]}{\sigma_m^2[c][q]}$$

provides a fairly good measure of audibility for quantization noise. When NMR[c][q]<1, the quantization noise is below the masking threshold and, hence, is not audible.

Figure 7:
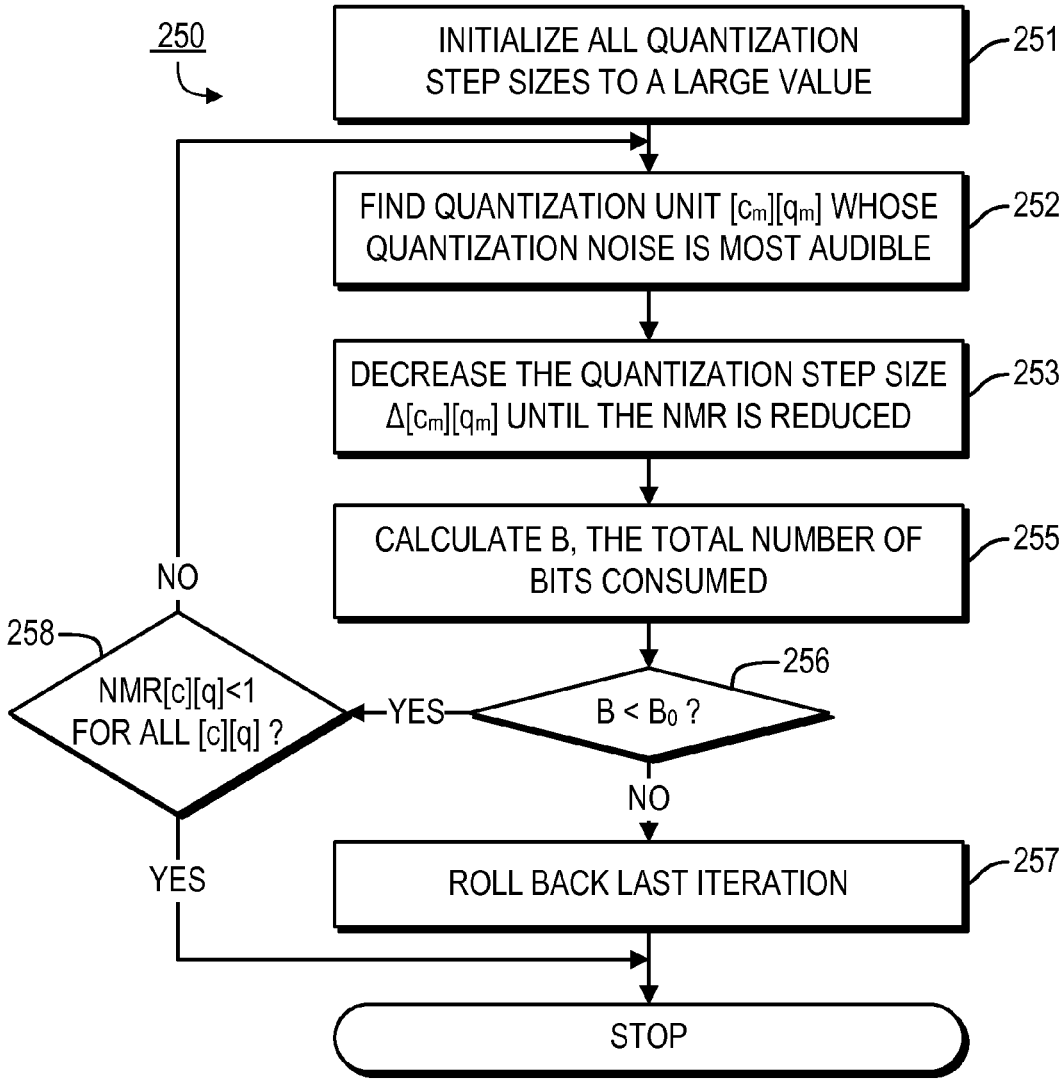
FIG. 7 is a flow diagram illustrating a process for allocating bits to quantization units pertaining to individually coded channels.

A straightforward bit-allocation strategy, called a water-filling algorithm, is to iteratively allocate bits to the quantization unit whose quantization noise currently is determined to be most audible, until the bit resource is exhausted or until the quantization noise in all quantization units is below the audible threshold. One example of such a process 250 is shown in FIG. 7. Typically, the steps of process 250 are fully automated so that they can be implemented by a processor reading and executing computer-executable process steps from a computer-readable medium, or in any of the other ways discussed herein.

Initially, in step 251 of process 250 all quantization step sizes are initialized to a large value, e.g.:

$$\Delta[c][q]=\text{Large Value},0\leqq c\leqq C,0\leqq q<Q.$$

In step 252, the quantization unit $[c_m][q_m]$ whose quantization noise is most audible is identified, e.g., as follows:

$$NMR[c_m][q_m] = \underset{0\leq c<C,0\leq q<Q}{\text{MAX}} NMR[c][q].$$

Figure 8:
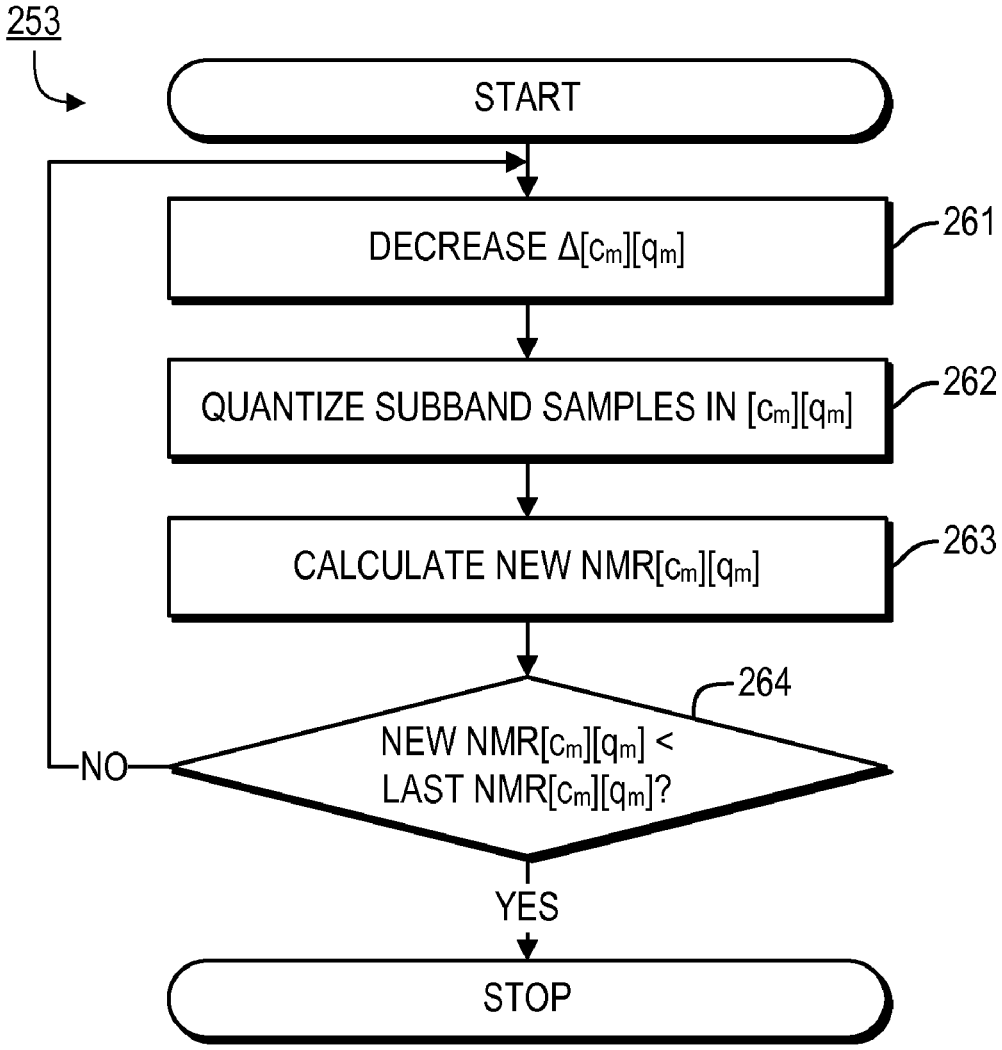
FIG. 8 is a flow diagram illustrating a process for decreasing quantization bit size when processing individually coded channels.

In step 253, the quantization step size $\Delta[c_m][q_m]$ is decreased until the NMR is reduced. A representative process for performing this step 253, illustrated in FIG. 8, is as follows:

a) in step 261, decrease $\Delta[c_m][q_m]$;
b) in step 262, quantize all subband samples in quantization unit $[c_m][q_m]$;
c) in step 263, calculate the new $NMR[c_m][q_m]$; and
d) in step 264, go back to step 261 if the new $NMR[c_m][q_m]$ is not smaller than the last time.

Returning to FIG. 7, in step 255 the total number of bits consumed so far, B, is determined.

In step 256, a determination is made as to whether $B<B_0$, where $B_0$ is the number of bits assigned to the current block. If not, processing proceeds to step 257 in which the last iteration of step 253 is rolled back so that $B<B_0$. If so, one or more additional bits are available for allocation, so processing proceeds to step 258.

In step 258, a determination is made as to whether the quantization noise is inaudible in all quantization units, e.g., as follows:

$$NMR[c][q]<1,0\leqq c<C,0\leqq q<Q.$$

If so, processing is complete (i.e., the available bit(s) do not need to be allocated). If not, processing returns to step 252 to continue allocating the available bit(s).

The above procedure assumes that each individual channel is coded discretely from the other channels so that the adjustment of quantization step size in a quantization unit (which corresponds to a single channel) does not affect the quantization noise power in any other channel. When joint channel coding is employed, however, this assumption cannot be made; in that case, the adjustment of the quantization step size in one quantization unit of a jointly coded channel can affect the quantization noise in all the channels that are joined. This problem preferably is addressed as follows.

Joint intensity coding is one of the most widely used joint channel coding techniques. It exploits the perceptual property of the human ear whereby the perception of stereo imaging depends largely on the relative intensity between the left and right channels at middle to high frequencies. Consequently, coding efficiency usually can be significantly improved by joint intensity coding, which typically involves the following procedure:

1. joining (adding) the subband samples in quantization units corresponding to middle to high frequencies to form a set of joint quantization units at this frequency range;
2. encoding subband samples only in this set of joint quantization units, thereby effectively reducing the number of subband samples to be coded in this joint frequency range by half;

3. encoding a steering vector which describes the relative intensities of the left and right channels per quantization unit in the joint frequency range; and
4. independently coding the remaining (not joined) quantization units in the middle to low frequencies of the left and right channels.

The joint quantization units can be aligned with the disjoint ones in either the left or right channel, resulting in significant imbalance between the left and right channels in terms of the number of quantization units. Other than this consideration, the left and right channels can still be considered as independent for bit allocation purpose. Consequently, the preferred embodiments of the following approach take special note that the numbers of quantization units among the channels can be significantly different from each other, and this difference preferably is taken into consideration when implementing the specific techniques of the present invention.

Sum/difference coding is different in this respect. Let 1 and r be the channel indexes for the left and right channels, respectively, and let s and d be the channel indexes for the sum and difference channels, respectively. In this case, the subband samples in a quantization unit q of the left and right channels preferably are joined to form the sum and difference channels as follows:

$$X[s][m]=0.5(X[l][m]+X[r][m]),m\epsilon q;\text{ and}$$

$$X[d][m]=0.5(X[l][m]-X[r][m]),m\epsilon q.$$

Afterwards, the sum/difference encoded subband samples are coded as if they were the normal channels. At the decoder side, the left and right channels can be reconstructed from the sum/difference channels as follows:

$$X[l][m]=X[s][m]+X[d][m],m\epsilon q;\text{ and}$$

$$X[r][m]=X[s][m]-X[d][m],m\epsilon q.$$

Note that, in the context of multichannel audio coding, the left and right channels are not restricted to the usual stereo channels. Instead, any left and right channel pairs can be sum/difference encoded, including front left and right channels, surround left and right channels, etc.

It is noted that sum/difference coding does not always result in a saving in bits, so a decision preferably is made as to whether to employ sum/difference coding. The preferred embodiments of the present invention propose a simple approach, in which the approximate entropies of employing and not employing sum/difference coding are compared. In one particular example, for quantization unit q, we calculate the total approximate entropy for the left and right channels, e.g., as:

$$H_{LR}=\sum_{m\in q}\log(1+|X[l][m]|)+\sum_{m\in q}\log(1+|X[r][m]|)$$

and for the sum/difference channels, e.g., as:

$$H_{SD}=\sum_{m\in q}\log(1+|X[s][m]|)+\sum_{m\in q}\log(1+|X[d][m]|).$$

Then, sum/difference coding is employed for quantization unit q if $H_{LR}>H_{SD}$, and is not employed otherwise.

In cases where the sum and difference subband samples are quantized and subsequently coded, the quantization step sizes are assigned to the sum and difference quantization units; there are no independent quantization step sizes for the corresponding left and right quantization units. This poses a problem for bit allocation procedures because quantization step sizes typically are the handle for controlling NMR, but there is no one-to-one correspondence between the quantization step size of a sum/difference quantization unit and the NMR of a left or right quantization unit.

A modification to the quantization step size of either the sum or difference quantization unit changes the quantization noise powers of both the corresponding left and right quantization units. On the other hand, for a particular quantization unit in either the left or right channel found to possess the maximum NMR, decrease of quantization step size in either the sum or difference quantization unit may decrease this NMR. Therefore, a decision preferably is made as to which quantization unit, either the sum or the difference, should be selected for reduction of quantization step size in order to decrease the NMR. The bit resource can be wasted if the right decision is not made.

In the preferred embodiments, the present invention addresses this problem by selecting either the sum or difference quantization unit based on the relative mean square quantization errors between the sum and difference quantization units. In one particular embodiment, if $$\sigma^2[s][q]>\sigma_2[d][q],$$

the sum quantization unit is selected as the target channel for step size reduction; otherwise, the difference quantization unit is selected.

Figure 9:
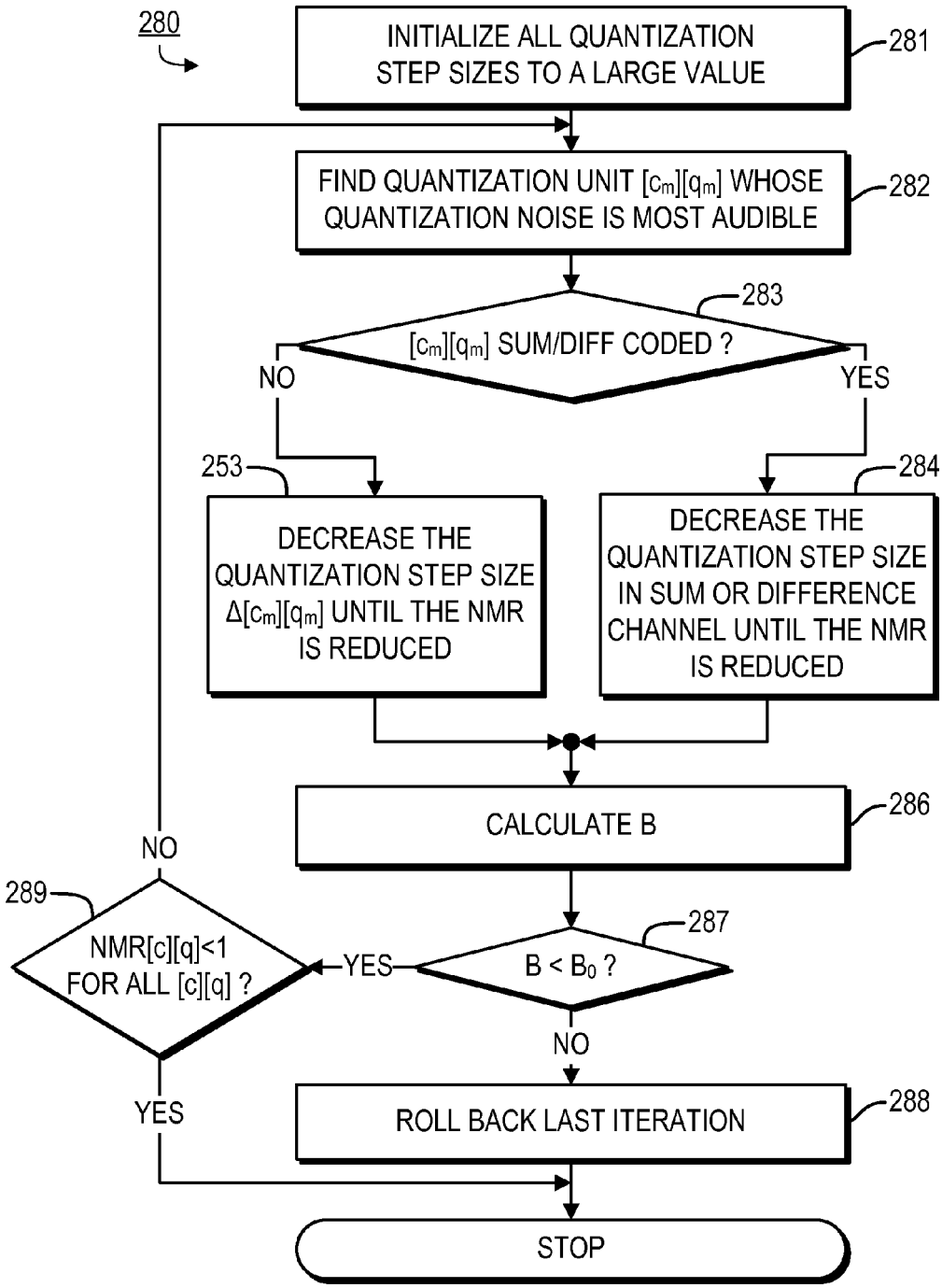
FIG. 9 is a flow diagram illustrating a process for allocating bits to quantization units pertaining to jointly coded channels.

FIG. 9 illustrates a process 280 for allocating bits to quantization units for joint channels. Preferably, the steps of process 280 are fully automated so that they can be implemented by a processor reading and executing computer-executable process steps from a computer-readable medium, or in any of the other ways discussed herein.

Initially, in step 281 all quantization step sizes are initialized to a large (preferably constant) value, e.g.:

$$\Delta[c][q]=\text{Large Value},0\leqq c<C,0\leqq q<Q.$$

In step 282, the quantization unit $[c_m][q_m]$ whose quantization noise is most audible is identified, e.g., as follows:

$$NMR[c_m][q_m]=\underset{0\leq c<C,0\leq q<Q}{\text{MAX}}NMR[c][q]$$

In step 283, a determination is made as to whether quantization unit $[c_m][q_m]$ is sum/difference coded. If not, processing proceeds to step 253 (discussed above), where the quantization step size Δ[cm][qm] is decreased until the NMR is reduced. On the other hand, if $[c_m][q_m]$ is sum/difference coded, processing proceeds to step 284.

Figure 10:
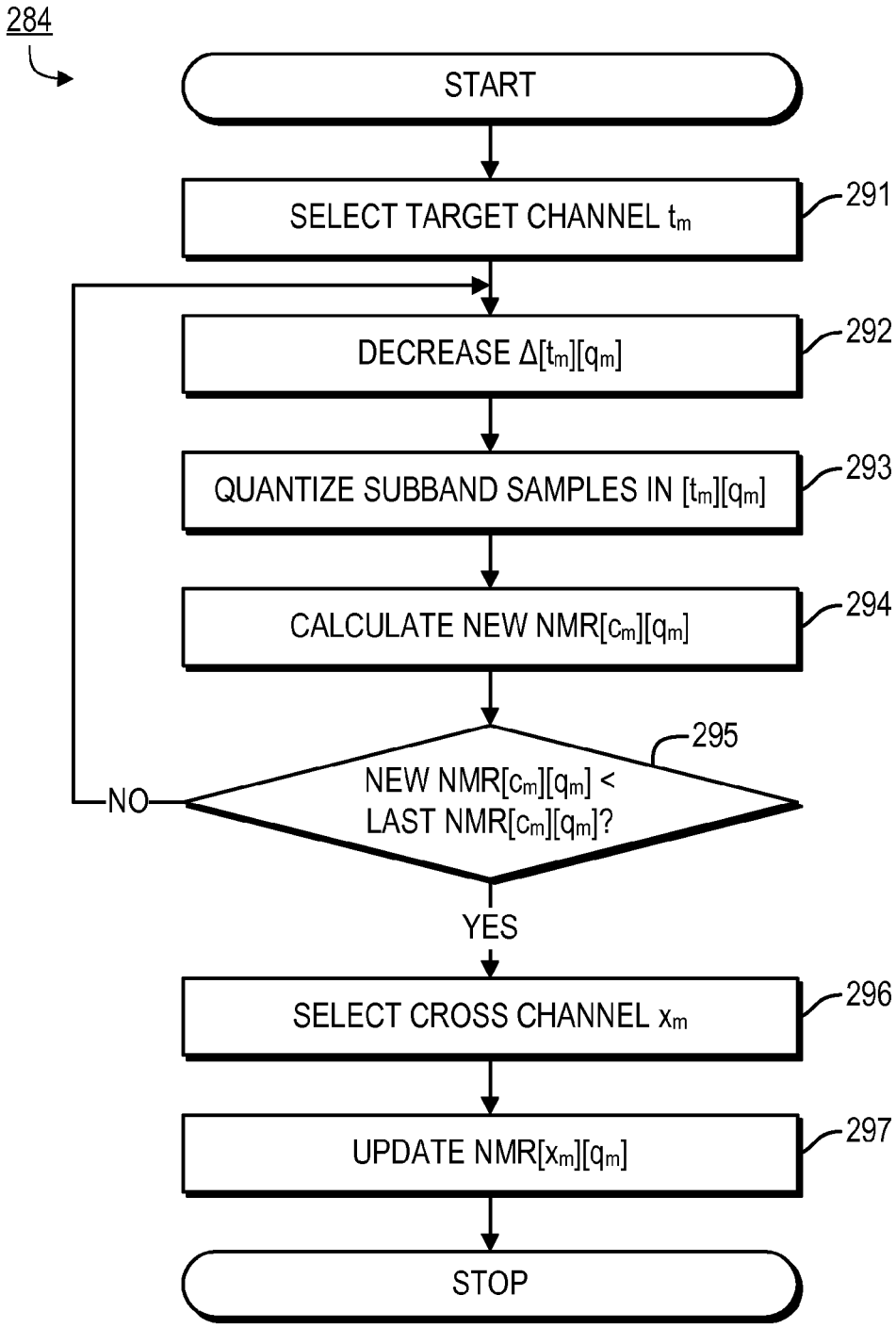
FIG. 10 is a flow diagram illustrating a process for decreasing quantization bit size when processing jointly coded channels.

In step 284, the quantization step size is decreased in a corresponding sum or difference channel until the NMR is reduced. A representative process for performing this step 284, illustrated in FIG. 10, is as follows:

a) in step 291, select target channel $t_m$, e.g. as follows:

$$t_m=\begin{cases}s_m, & \text{if } \sigma^2[s][q]>\sigma^2[d][q];\\ d_m, & \text{otherwise.}\end{cases}$$

b) in step 292, decrease $\Delta[t_m][q_m]$, e.g., to the next available value;

c) in step 293, quantize the sum or difference subband samples in quantization unit $[t_m][q_m]$;

d) in step 294, calculate the new $NMR[c_m][q_m]$;

e) in step 295, determine if the new $NMR[c_m][q_m]$ is smaller than the last time; if so, proceed to step 296; if not, return to step 292 in order to further decrease $\Delta[t_m][q_m]$;

f) in step 296, select the cross channel $x_m$ as follows:

$$x_m = \begin{cases} r_m, & \text{if } c_m = l_m; \\ l_m, & \text{otherwise;} \end{cases}$$

and g) in step 297, update $NMR[x_m][q_m]$.

Returning to FIG. 9, upon completion of step 253 or 284, as applicable, step 286 is performed, in which the total number of bits consumed so far, B, is calculated.

In step 287, a determination is made as to whether $B<B_0$, where $B_0$ is the number of bits assigned to the current block. If not, processing proceeds to step 288, in which the last iteration (of step 253 or 284, as applicable) is rolled back so that $B<B_0$. If so, one or more additional bits are available for allocation, so processing proceeds to step 289.

In step 289 a determination is made as to whether the quantization noise in all quantization units is inaudible, e.g., as follows:

$$NMR[c][q]<1, 0 \leqq c<C, 0 \leqq q<Q.$$

If so, processing is complete (i.e., the available bit(s) do not need to be allocated). If not, processing returns to step 282 to continue allocating the available bit(s).

It is noted that process 280 is presented above in the context of one block, but it can be readily extended to a frame that includes multiple blocks, e.g., simply by extending steps 281, 282, 286 and 289 so that all blocks in the frame are taken into consideration. Such an extension generally would require no changes to steps 283, 253 and 284 because they operate on the quantization unit with the maximum NMR, or to steps 287 and 288 because such steps are block-blind.

System Environment.

Generally speaking, except where clearly indicated otherwise, all of the systems, methods and techniques described herein can be practiced with the use of one or more programmable general-purpose computing devices. Such devices typically will include, for example, at least some of the following components interconnected with each other, e.g., via a common bus: one or more central processing units (CPUs); read-only memory (ROM); random access memory (RAM); input/output software and circuitry for interfacing with other devices (e.g., using a hardwired connection, such as a serial port, a parallel port, a USB connection or a firewire connection, or using a wireless protocol, such as Bluetooth or a 802.11 protocol); software and circuitry for connecting to one or more networks, e.g., using a hardwired connection such as an Ethernet card or a wireless protocol, such as code division multiple access (CDMA), global system for mobile communications (GSM), Bluetooth, a 802.11 protocol, or any other cellular-based or non-cellular-based system, which networks, in turn, in many embodiments of the invention, connect to the Internet or to any other networks; a display (such as a cathode ray tube display, a liquid crystal display, an organic light-emitting display, a polymeric light-emitting display or any other thin-film display); other output devices (such as one or more speakers, a headphone set and a printer); one or more input devices (such as a mouse, touchpad, tablet, touch-sensitive display or other pointing device, a keyboard, a keypad, a microphone and a scanner); a mass storage unit (such as a hard disk drive); a real-time clock; a removable storage read/write device (such as for reading from and writing to RAM, a magnetic disk, a magnetic tape, an opto-magnetic disk, an optical disk, or the like); and a modem (e.g., for sending faxes or for connecting to the Internet or to any other computer network via a dial-up connection). In operation, the process steps to implement the above methods and functionality, to the extent performed by such a general-purpose computer, typically initially are stored in mass storage (e.g., the hard disk), are downloaded into RAM and then are executed by the CPU out of RAM. However, in some cases the process steps initially are stored in RAM or ROM.

Suitable general-purpose programmable devices for use in implementing the present invention may be obtained from various vendors. In the various embodiments, different types of devices are used depending upon the size and complexity of the tasks. Such devices can include, e.g., mainframe computers, multiprocessor computers, workstations, personal computers and/or even smaller computers, such as PDAs, wireless telephones or any other programmable appliance or device, whether stand-alone, hard-wired into a network or wirelessly connected to a network.

In addition, although general-purpose programmable devices have been described above, in alternate embodiments one or more special-purpose processors or computers instead (or in addition) are used. In general, it should be noted that, except as expressly noted otherwise, any of the functionality described above can be implemented in software, hardware, firmware or any combination of these, with the particular implementation being selected based on known engineering tradeoffs. More specifically, where any process and/or functionality described above is implemented in a fixed, predetermined and/or logical manner, it can be accomplished through programming (e.g., software or firmware), an appropriate arrangement of logic components (hardware) or any combination of the two, as will be readily appreciated by those skilled in the art. In other words, it is well-understood how to convert logical and/or arithmetic operations into instructions for performing such operations within a processor and/or into logic gate configurations for performing such operations; in fact, compilers typically are available for both kinds of conversions.

It should be understood that the present invention also relates to machine-readable media on which are stored software or firmware program instructions (i.e., computer-executable process instructions) for performing the methods and functionality of this invention. Such media include, by way of example, magnetic disks, magnetic tape, optically readable media such as CD ROMs and DVD ROMs, or semiconductor memory such as PCMCIA cards, various types of memory cards, USB memory devices, etc. In each case, the medium may take the form of a portable item such as a miniature disk drive or a small disk, diskette, cassette, cartridge, card, stick etc., or it may take the form of a relatively larger or immobile item such as a hard disk drive, ROM or RAM provided in a computer or other device. As used herein, unless clearly noted otherwise, references to computer-executable process steps stored on a computer-readable or machine-readable medium are intended to encompass situations in which such process steps are stored on a single medium, as well as situations in which such process steps are stored across multiple media.

The foregoing description primarily emphasizes electronic computers and devices. However, it should be understood that any other computing or other type of device instead may be used, such as a device utilizing any combination of electronic, optical, biological and chemical processing that is capable of performing basic logical and/or arithmetic operations.

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A method of merging entropy codebook application ranges within an audio signal, comprising:

obtaining an audio signal that includes quantization indexes, identification of segments of said quantization indexes, and indexes of entropy codebooks that have been assigned to said segments, with a single entropy codebook index having been assigned to each said segment;

identifying potential merging operations in which specified segments potentially would be merged with each other;

estimating bit penalties for the potential merging operations; and performing the potential merging operation having the lowest estimated bit penalty.

2. A method according to claim 1, further comprising a step of repeating said identifying, estimating and performing steps until a specified criterion is satisfied.

3. A method according to claim 2, wherein said specified criterion comprises reducing the segments to a specified number of segments that has been fixed in advance.

4. A method according to claim 2, wherein said specified criterion comprises reducing the segments to different specified numbers of segments and then selecting the number of segments resulting in the greatest bit efficiency.

5. A method according to claim 2, wherein said specified criterion comprises a bit-saving criterion.

6. A method according to claim 5, wherein said specified criterion comprises that actual net bit savings from eliminating segments remains positive.

7. A method according to claim 2, wherein said specified criterion comprises that estimated net bit savings from eliminating segments remains positive.

8. A method according to claim 1, wherein said identifying step comprises evaluating, for each of a plurality of the segments, whether said segment potentially should be merged with its immediate left neighbor or its immediate right neighbor.

9. A method according to claim 8, wherein: (1) if said segment has an entropy codebook that is smaller than both of its neighbors, a merger between said segment and its neighbor having the smaller entropy codebook is identified as a potential merging operation; (2) if said segment has an entropy codebook that is between those of its neighbors, a merger between said segment and its neighbor having the larger entropy codebook is identified as a potential merging operation; and (3) if said segment has an entropy codebook that is larger than both of its neighbors, no potential merging operation is identified.

10. A method according to claim 1, wherein at least one of said identified potential merging operations comprises merging more than two segments.

11. A method according to claim 10, wherein the estimated bit penalty for said at least one of said identified potential merging operations that comprises merging more than two segments is adjusted to account for elimination of an additional segment.

12. A method according to claim 11, wherein said at least one of said identified potential merging operations comprises merging three segments and the adjustment of its bit penalty is a halving of what its bit penalty otherwise would be.

13. A method according to claim 10, wherein said at least one of said identified potential merging operations comprises merging three segments and for purposes of said performing step, its bit penalty is compared against the combined lowest bit penalties for a current and a next iteration.

14. A method according to claim 10, wherein the potential merging operations are identified through the use of a comprehensive search.

15. A method according to claim 10, wherein the potential merging operations are identified through the use of a linear programming technique.

16. A computer-readable medium storing computer executable process steps for merging entropy codebook application ranges within an audio signal, said process steps comprising:

obtaining an audio signal that includes quantization indexes, identification of segments of said quantization indexes, and indexes of entropy codebooks that have been assigned to said segments, with a single entropy codebook index having been assigned to each said segment;

identifying potential merging operations in which specified segments potentially would be merged with each other;

estimating bit penalties for the potential merging operations; and performing the potential merging operation having the lowest estimated bit penalty.

17. An apparatus for merging entropy codebook application ranges within an audio signal, comprising:

means for obtaining an audio signal that includes quantization indexes, identification of segments of said quantization indexes, and indexes of entropy codebooks that have been assigned to said segments, with a single entropy codebook index having been assigned to each said segment;

means for identifying potential merging operations in which specified segments potentially would be merged with each other;

means for estimating bit penalties for the potential merging operations; and means for performing the potential merging operation having the lowest estimated bit penalty.

* * * * *

UNITED STATES PATENT AND TRADEMARK OFFICE

CERTIFICATE OF CORRECTION

PATENT NO. : 8,255,208 B2
APPLICATION NO. : 13/216111
DATED : August 28, 2012
INVENTOR(S) : Yuli You It is certified that error appears in the above-identified patent and that said Letters Patent is hereby corrected as shown below:

In column 14 line 7, change "$\Delta[c][q]$ = Large Value, $0 \leq c \leq C, 0 \leq q < Q$." to -- $\Delta[c][q]$ = Large Value, $0 \leq c < C, 0 \leq q < Q$. --.

In column 16 line 25, change "$\sigma^2[s][q] > \sigma_2[d][q]$" to -- $\sigma^2[s][q] > \sigma^2[d][q]$ --.

Signed and Sealed this
Twenty-third Day of October, 2012

David J. Kappos

David J. Kappos
*Director of the United States Patent and Trademark Office*